US011178502B2

(12) United States Patent
Saito

(10) Patent No.: US 11,178,502 B2
(45) Date of Patent: Nov. 16, 2021

(54) AUDIO MIXER AND CONTROL METHOD OF AUDIO MIXER

(71) Applicant: YAMAHA CORPORATION, Hamamatsu (JP)

(72) Inventor: Kosuke Saito, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/216,034

(22) Filed: Dec. 11, 2018

(65) Prior Publication Data

US 2019/0191261 A1 Jun. 20, 2019

(30) Foreign Application Priority Data

Dec. 15, 2017 (JP) ..... JP2017-240152

(51) Int. Cl.
*H04S 7/00* (2006.01)
*H04H 60/04* (2008.01)
*H04S 3/00* (2006.01)

(52) U.S. Cl.
CPC ..... *H04S 7/30* (2013.01); *H04H 60/04* (2013.01); *H04S 3/008* (2013.01); *H04S 2400/01* (2013.01); *H04S 2400/13* (2013.01); *H04S 2420/07* (2013.01)

(58) Field of Classification Search
CPC . H04H 60/04; H04S 2400/01; H04S 2400/13; H04S 2420/07; H04S 3/008; H04S 7/30
USPC ..... 700/94; 381/82, 119, 123
See application file for complete search history.

(56) References Cited

U.S. PATENT DOCUMENTS

2004/0028248 A1* 2/2004 Terada ..... H04H 60/04 381/119
2011/0075864 A1* 3/2011 Hagiwara ..... H04H 60/04 381/119

FOREIGN PATENT DOCUMENTS

JP 2004072295 A 3/2004

OTHER PUBLICATIONS

Office Action issued in Japanese Appln. No. 2017-240152 dated Aug. 24, 2021. English machine translation provided.

* cited by examiner

*Primary Examiner* — Duc Nguyen
*Assistant Examiner* — Alexander L Eljaiek
(74) *Attorney, Agent, or Firm* — Rossi, Kimms & McDowell LLP

(57) ABSTRACT

An audio mixer includes a reception portion and a controller. The reception portion receives a user's operation. The controller performs: display processing that displays a screen indicating a correspondence between a plurality of channels and a bus on a display; and setting processing that, when a specific operation is received through the reception portion and the channel is specified, associates the specified channel with a specific bus and outputs signals other than a signal of the associated channel from the specific bus.

14 Claims, 14 Drawing Sheets

AUDIO MIXER AND CONTROL METHOD OF AUDIO MIXER

CROSS REFERENCE TO RELATED APPLICATIONS

This Nonprovisional application claims priority under 35 U.S.C. § 119(a) on Patent Application No. 2017-240152 filed in Japan on Dec. 15, 2017 the entire contents of which are hereby incorporated by reference.

BACKGROUND OF THE INVENTION

1. Field of the Invention

A preferred embodiment of the present invention relate to an audio mixer, a control method of the audio mixer.

2. Description of the Related Art

For instance, Patent Literature 1 (Unexamined Japanese Patent Publication No. 2004-72295) discloses a "mix minus" function that performs such a setting that a signal of any input channel, among a plurality of input channels, is not supplied to a mixing bus. For instance, the mix minus function is used for preventing a sound lag, i.e., when an announcer speaks at a relay-point station while monitoring sounds (e.g., voice for broadcasting) of a mixing bus, the announcer hears one's own voice behind one's speaking.

The mix minus function is set as follows, for example. First, a user starts a bus setup screen. The user specifies any buses as a mix minus bus in the setup screen. Further, the user starts a screen for specifying a minus-target channel. After that, the user specifies the minus-target channel.

SUMMARY OF THE INVENTION

In the above setting, however, it is necessary for a user to start a bus setup screen in advance and specify a target bus. After that, the user is needed to start a screen for specifying a minus-target channel and specify the channel. This causes troublesomeness.

In view of the foregoing, a preferred embodiment of the present invention is directed to provide an audio mixer capable of setting a mix minus function more quickly and simply than before, and a control method of the audio mixer.

An audio mixer includes a reception portion and a controller. The reception portion receives a user's operation. The controller performs: display processing that displays a screen indicating a correspondence between a plurality of channels and a bus on a display; and setting processing that, when a specific operation is received through the reception portion and a channel is specified, associates the specified channel with a specific bus and outputs a signal of channels other than the associated channel to the specific bus.

According to a preferred embodiment of the present invention, the mix minus function can be set more quickly and simply than before.

The above and other elements, features, characteristics, and advantages of the present invention will become more apparent from the following detailed description of the preferred embodiments with reference to the attached drawings.

DETAILED DESCRIPTION OF THE PREFERRED EMBODIMENTS

Figure 1:
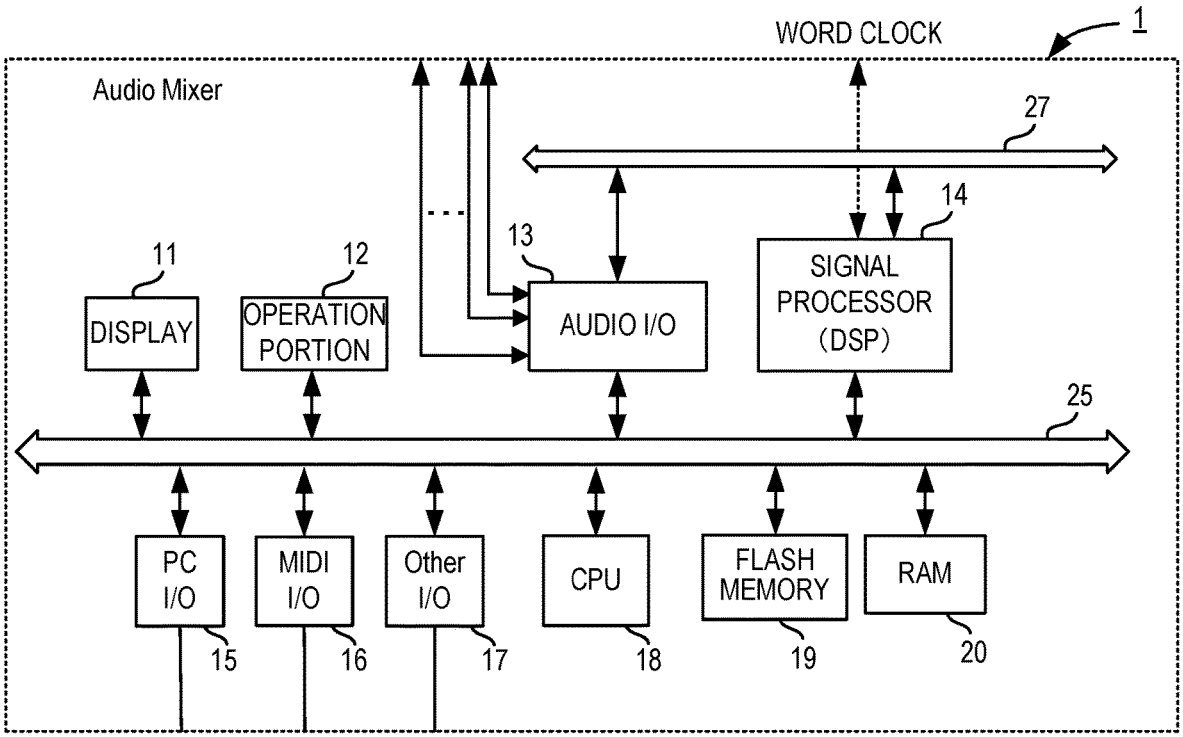
FIG. 1 is a block diagram showing a configuration of an audio mixer 1.

FIG. 1 is a block diagram showing a configuration of an audio mixer 1. The audio mixer 1 includes a display 11, an operation portion 12, and an audio I/O (Input/Output) 13, a signal processor 14, a PCI/O 15, a MIDI_I/O 16, other I/O 17, a CPU 18, a flash memory 19, and a RAM 20.

The display 11, the operation portion 12, the audio I/O 13, the signal processor 14, the PCI/O 15, the MIDI_I/O 16, the other I/O 17, the CPU 18, the flash memory 19, and the RAM 20 are connected with one another through a bus 25. Further, the audio I/O 13 and the signal processor 14 are also connected to a waveform bus 27 for transmitting digital audio signals.

The audio I/O 13 is an interface for inputting audio signals. In the audio I/O 13, an analog input port, a digital input port, or the like is provided to input the audio signals. Further, the audio I/O 13 is an interface for outputting audio signals processed in the signal processor 14. In the audio I/O 13, an analog output port, a digital output port, or the like is provided to output the audio signals.

The PCI/O 15, the MIDI_I/O 16, and the other I/O 17 each are interfaces that are connected to various kinds of external apparatuses to perform output and input. For instance, an external PC is connected to the PCI/O 15. Further, an apparatus suitable for MIDI (Musical Instrument Digital Interface), such as a physical controller or electronic instrument, is connected to the MIDI_I/O 16. A display is connected to the other I/O 17, for example. Alternatively, UI (User Interface) devices, such as a mouse and a keyboard, are connected to the other I/O 17. Any standards, such as Ethernet (registered trademark) and USB (Universal Serial Bus), can be used for communication with the external apparatuses. Further, wire-based or wireless-based connection may be employed.

The CPU 18 is a controller that controls operation of the audio mixer 1. The CPU 18 reads out a predetermined program stored in the flash memory 19, serving as one of storage mediums, into the RAM 20 to perform various kinds of operations. Note that, it is not essential to store the program in the flash memory 19. For instance, the CPU 18 may download the program from a server via a network, and execute it.

The CPU 18 controls the display 11 to display various kinds of information. The display 11 is constituted by, for example, an LCD or a light emitting diode (LED).

The operation portion 12 corresponds to a reception portion that receives an operation from a user to the audio mixer 1. The operation portion 12 is constituted by various kinds of keys, buttons, a rotary encoder, a slider, and the like. Further, the operation portion 12 may be constituted by a touch panel laminated on the LCD serving as the display 11.

The signal processor 14 is constituted by a plurality of DSPs (Digital Signal Processors) for performing various kinds of signal processing, such as mixing processing and effect processing. In the signal processor 14, the audio signal supplied from audio the I/O 13 through the waveform bus 27 is subjected to effect processing, such as mixing processing or equalizing. The signal processor 14 outputs the digital audio signal, which has been subjected to the signal processing, to the audio I/O 13 again through the waveform bus 27.

Figure 2:
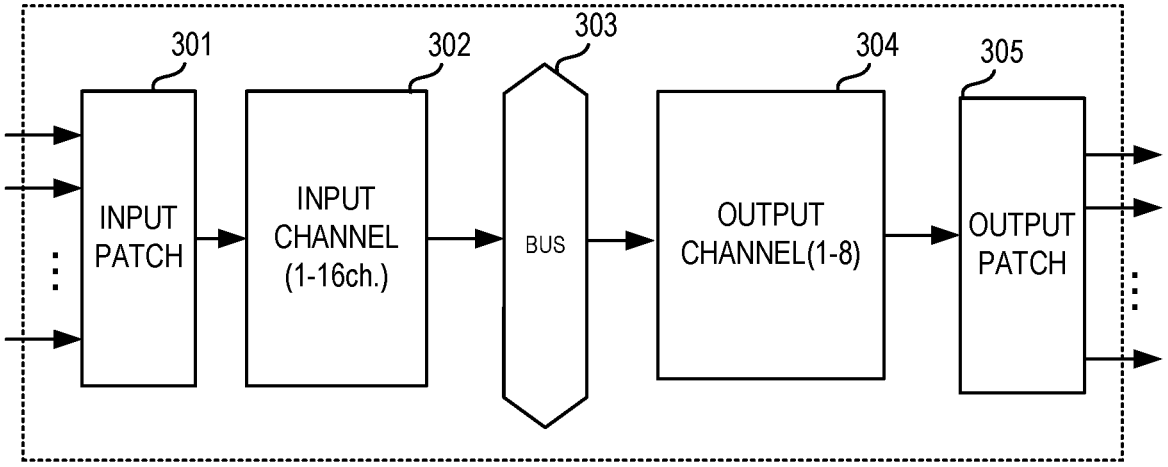
FIG. 2 is an equivalent block diagram of signal processing that is performed in a signal processor 14, an audio I/O 13, and a CPU 18.

FIG. 2 is a functional block diagram of signal processing that is performed in the signal processor 14, the audio I/O 13, and the CPU 18. As shown in FIG. 2, the signal processing is functionally performed through an input patch 301, an input channel 302, a bus 303, an output channel 304, and an output patch 305.

The input patch 301 receives an audio signal from a plurality of input ports (e.g., an analog input port or a digital input port) in the audio I/O 13. In the input patch 301, any one of the plurality of ports is assigned to at least one of a plurality of channels (e.g., 32 ch). Thus, the audio signal is supplied to each channel in the input channel 302.

At each channel in the input channel 302, the various kinds of signal processing, such as equalizing and compressing, are performed. Further, at each channel in the input channel 302, the audio signal subjected to the signal processing is level-adjusted, and then sent to the bus 303 located in the latter step.

The bus 303 receives the audio signal from each channel in the input channel 302. The bus is constituted by a master output bus (e.g., a stereo bus), a monitor MIX bus, and the like. A user operates the operation portion 12 such that each channel in the input channel 302 is associated with a corresponding one of buses in the bus 303.

The output channel 304 has the number of channels (e.g., eight channels) corresponding to the number of buses of the bus 303. At each channel in the output channel 304, various kinds of signal processing are applied to an audio signal to be inputted, like the input channel. At each channel in the output channel 304, the audio signal subjected to the signal processing is sent to the output patch 305. In the output patch 305, each channel in the output channel 304 is assigned to any one of a plurality of ports serving as an analog output port or a digital output port. Thus, the audio signal that has been subjected to the signal processing is supplied to the audio I/O 13.

Figure 3:
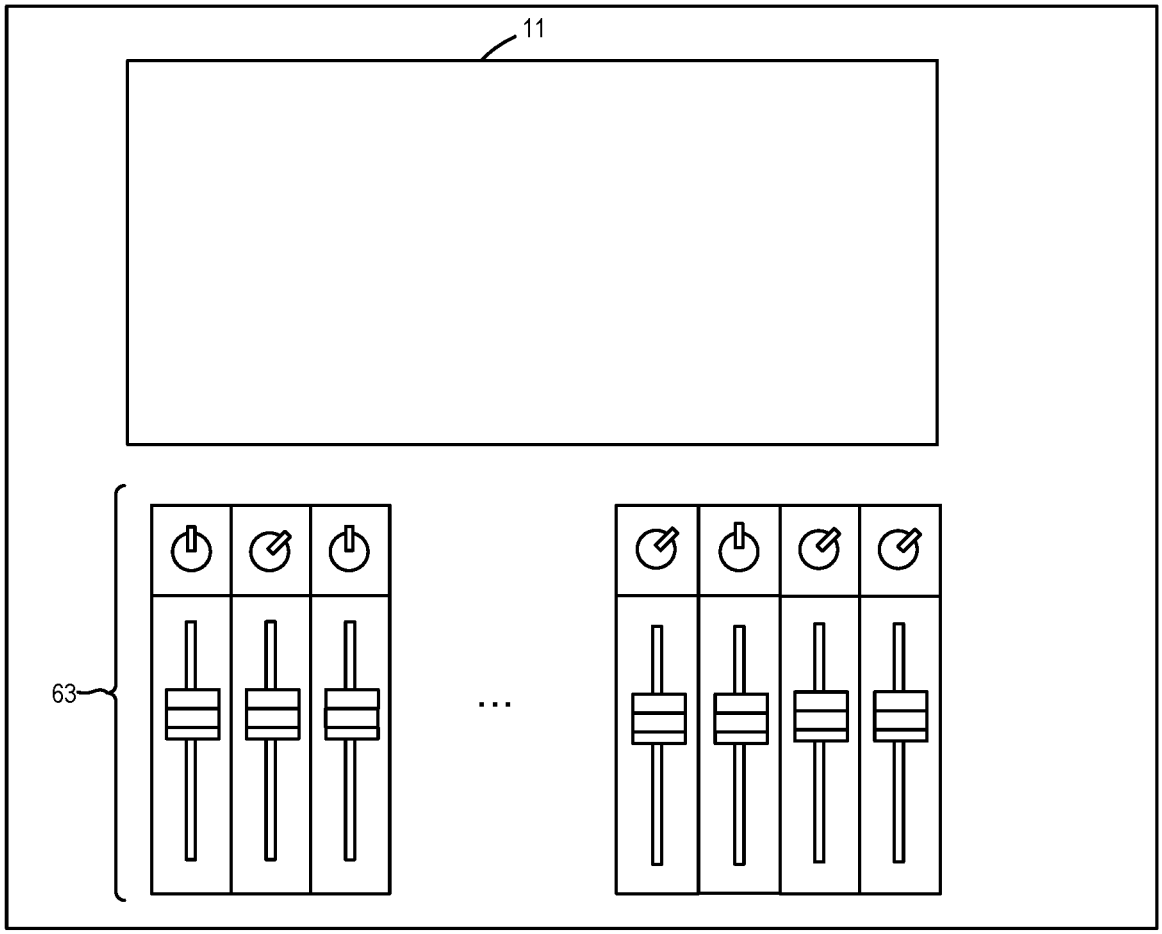
FIG. 3 is a view showing a principal configuration of an operation panel of the audio mixer 1.

FIG. 3 is a view showing a principal configuration of an operation panel of the audio mixer 1. As shown in FIG. 3, the display 11 and a channel strip 63 are provided on the operation panel of the audio mixer 1. The channel strip is an example of the operation portion 12. Note that, a touch panel is incorporated in the display 11 to constitute a part of the operation portion 12. In other words, the display 11 displays a GUI (Graphical User Interface) screen for receiving a user's operation.

The channel strip 63 is an area in which a plurality of operation elements, each receiving an operation for one channel, are arranged vertically. In FIG. 3, only a fader and a knob are displayed for every channel as an operation element, but in practice, many knobs, switches, or the like are installed. In the channel strip 63, a plurality of faders and knobs (e.g., 16), which are disposed on the left-hand side, correspond to input channels. In the channel strip 63, two faders and two knobs, which are disposed on the right-hand side, are operation elements corresponding to a master output (two channels). In the audio mixer 1 of the present embodiment, a screen indicating a correspondence between each of the plurality of channels and the buses is displayed on the display 11 to receive a user's operation. Especially, the audio mixer 1 of the present embodiment receives a setup operation of associating each of the plurality of channels with the buses.

Figure 4:
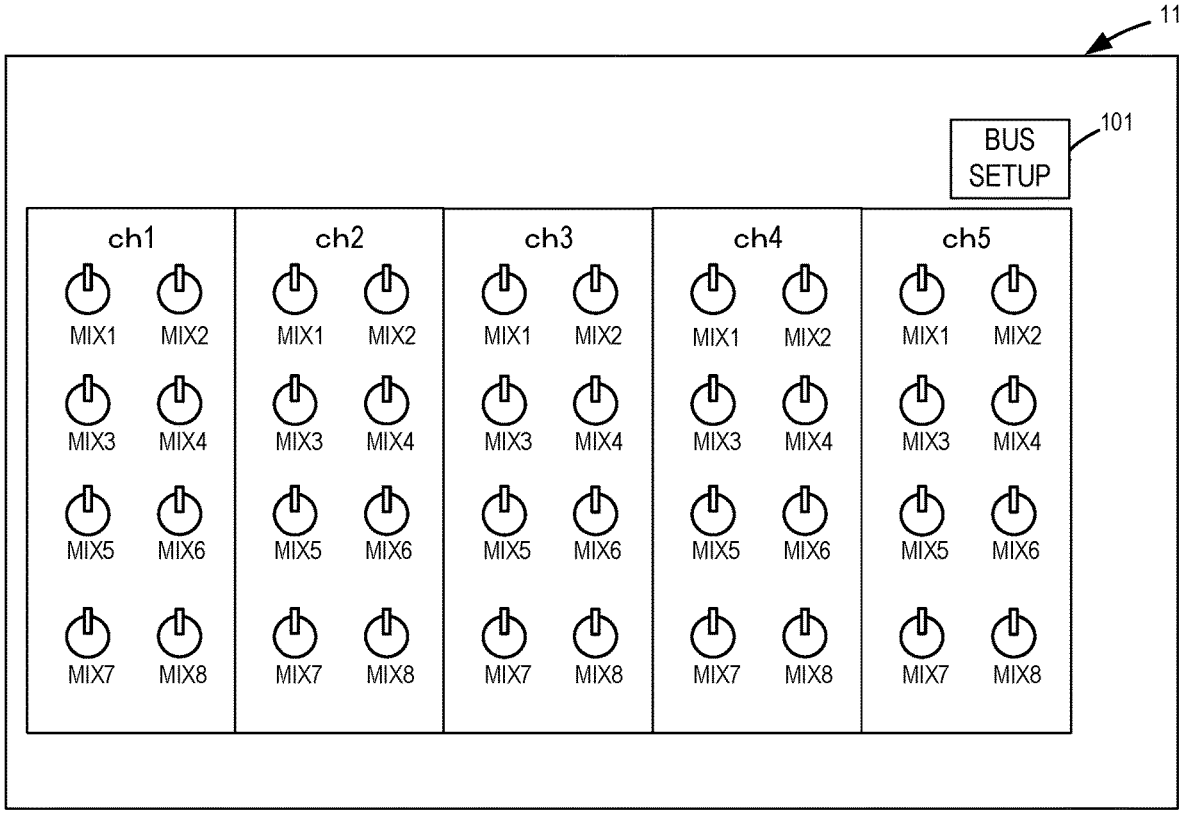
FIG. 4 is a view showing an example of a channel overview screen.
Figure 5:
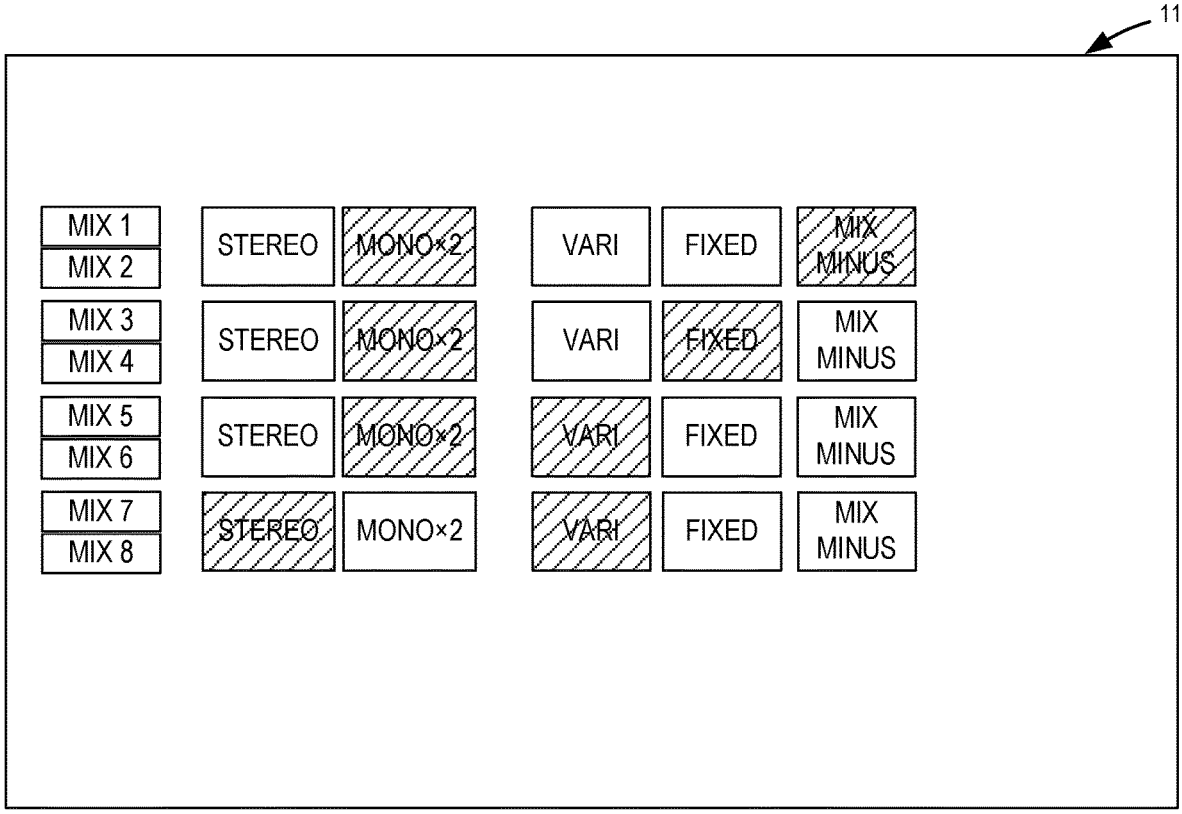
FIG. 5 is a view showing an example of a bus setup screen.

FIG. 4 is a view showing an example of a channel overview screen, and FIG. 5 is a view showing an example of a bus setup screen. As shown in FIG. 4, in the channel overview screen, a SEND level to a MIX bus is displayed for every channel. Note that, in practice, the channel overview screen displays various kinds of setting, such as contents of the signal processing, in each channel. In the example, however, only a SEND level to a MIX bus is shown for description. Further, in the example, it is illustrated, by example, that only five channels are displayed on the display 11. In practice, however, the channel overview screen displays channels having the same number of channels in the channel strip 63 on the display 11.

When a user touches a bus setup button 101 in the channel overview screen, the CPU 18 displays the bus setup screen, which is shown in FIG. 5, on the display 11.

In the bus setup screen, the plurality of MIX buses (eight buses in the example) each are set up. For instance, each MIX bus may be set as either a monaural bus or a stereo bus. When each MIX bus is set as the stereo bus, two MIX buses (e.g., MIX7 and MIX8) are related to each other. Further, each MIX bus may be set as one of three types, i.e., VARI (Variable), FIXED, and MIX MINUS. A bus of a VARI type is a bus whose SEND level is variable. A bus of a FIXED type is a bus whose SEND level is fixed. A bus of a MIX MINUS type is a bus that sends a signal of channels other than the channel specified by a user. For instance, the bus of a MIX MINUS type is used for preventing a sound lag, i.e., when an announcer speaks at a relay-point station while monitoring sounds (e.g., voice for broadcasting) of a mixing bus, the announcer hears one's own voice behind one's speaking. When a channel 1 is associated with a microphone of the announcer in a relay-point station, a user instructs to specify the channel 1 as the bus of a MIX MINUS type. In this case, the channel 1 is set as an owner channel of the MIX MINUS bus. The bus of a MIX MINUS type mixes sounds of channels other than the owner channel, and then outputs them.

In the example, MIX1 and MIX2 are set up as the bus of a MIX MINUS type. MIX3 and MIX4 are set up as the bus of a FIXED type. MIX5, MIX6, MIX7, and MIX8 are set up as the bus of a VARI type.

Figure 6A:
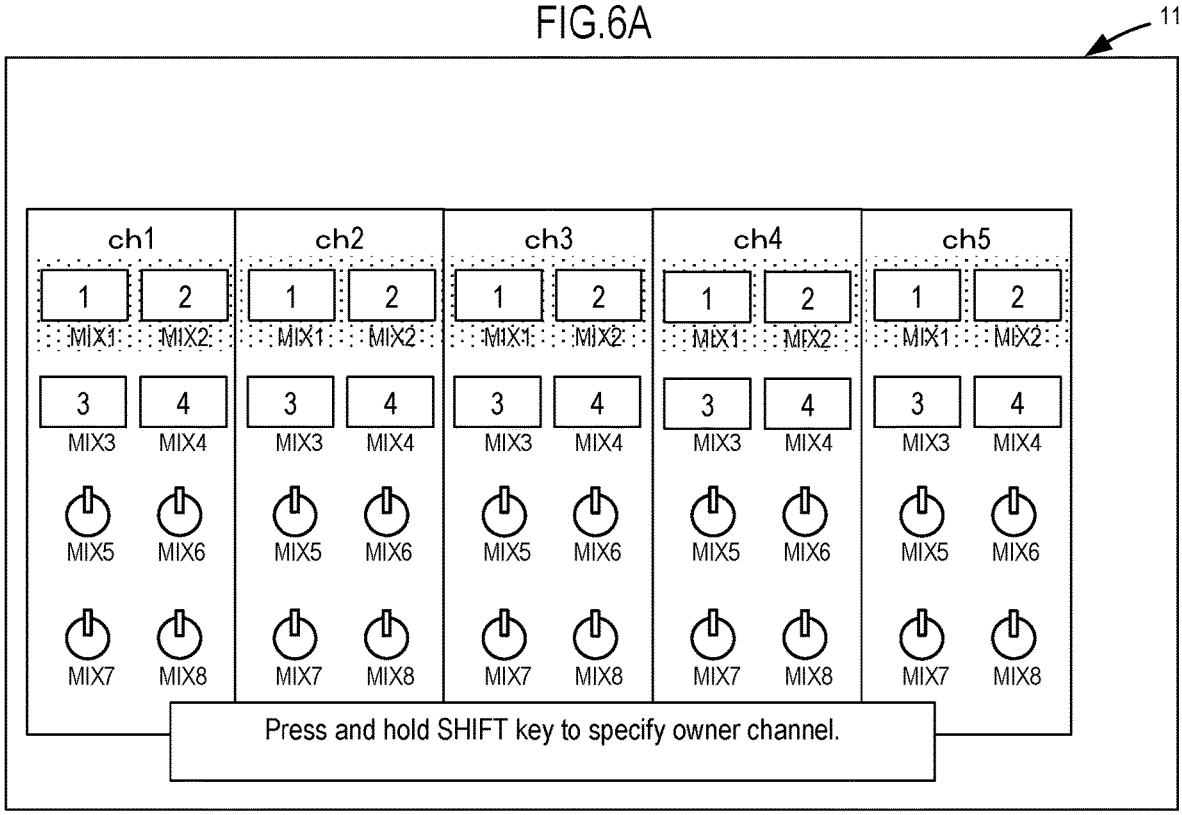
FIG. 6A is a view showing the channel overview screen when a bus of a MIX MINUS type is set up.
Figure 7:
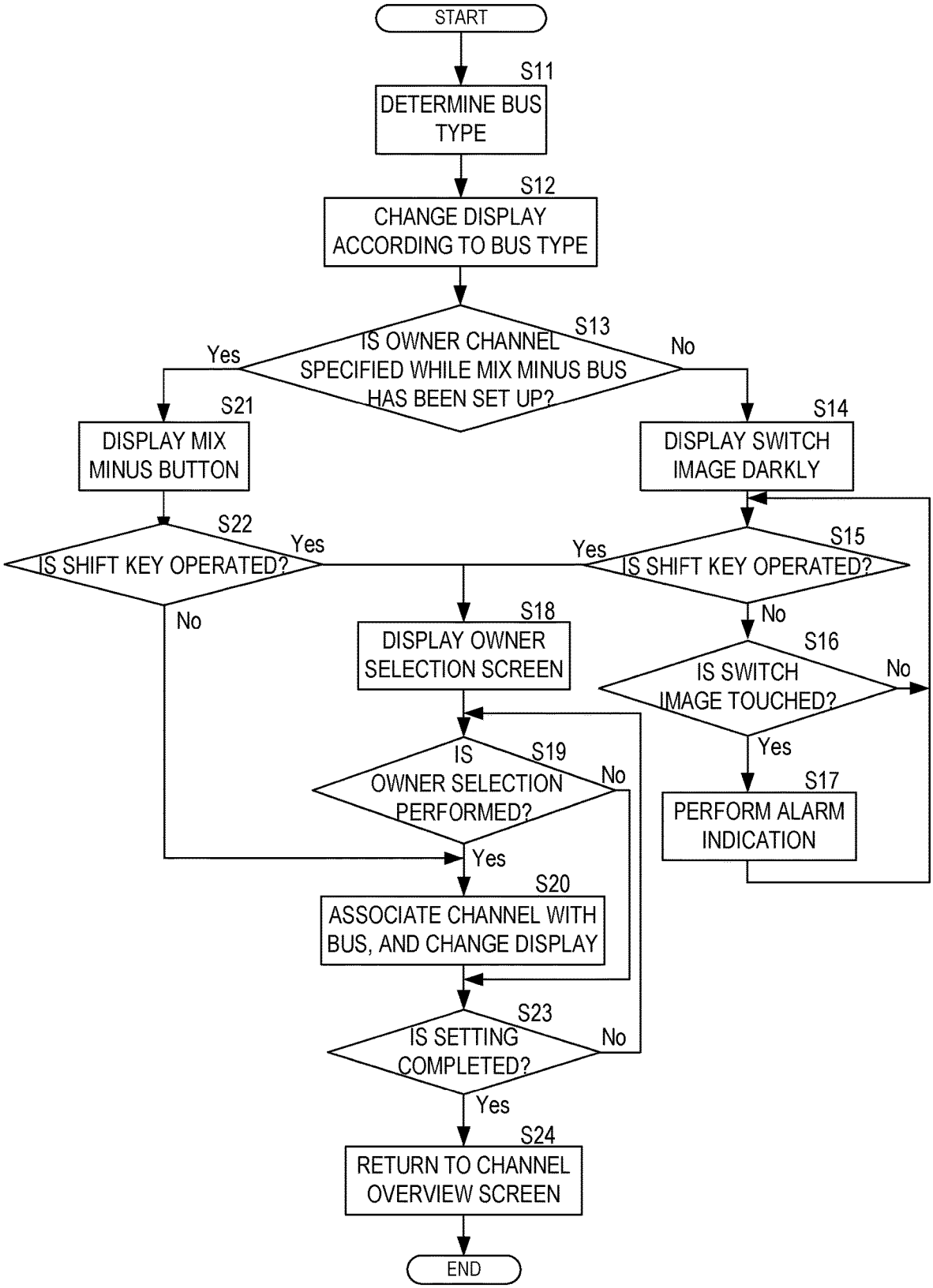
FIG. 7 is a flowchart showing an operation of the CPU 18.

FIG. 6A is a view showing a channel overview screen when the bus of a MIX MINUS type is set up, and FIG. 7 is a flowchart showing an operation of the CPU 18. When the channel overview screen is displayed, the CPU 18 performs the operation shown in FIG. 7.

First, the CPU 18 determines what type of bus is used for each bus (S11). Then, the CPU 18 changes a display mode according to the bus type (S12).

For instance, in the example shown in FIG. 5, MIX1 and MIX2 are set up as the bus of a MIX MINUS type. Further, MIX3 and MIX4 are set up as the bus of a FIXED type. MIX5, MIX6, MIX7, and MIX8 are set up as the bus of a VARI type. For the bus of a MIX MINUS type, the SEND level thereof is fixed, as well as the bus of a FIXED type. On the other hand, for the bus of a VARI type, the SEND level thereof is variable. Accordingly, as is shown in FIG. 6A, the CPU 18 displays the bus of a MIX MINUS type and the bus of a FIXED type as switch images with a rectangular shape. On the other hand, the CPU 18 displays the bus of a VARI type as a knob image. Since the bus of a VARI type is displayed as the knob image, the user can understand its current SEND level easily. On the other hand, since the bus of a MIX MINUS type and the bus of a FIXED type are displayed as the switch images with a rectangular shape, a user can understand that these buses are of a bus type whose SEND level is fixed. Further, by touching the switch image, the user can also instruct whether or not to output a signal of the specified channel to the bus.

Furthermore, as shown in FIG. 6A, the CPU 18 displays MIX1 and MIX2 such that the background color thereof is grayed out. Thus, the user can easily understand a difference between the bus of a MIX MINUS type and the bus of a FIXED type, of which the SEND levels are fixed.

As mentioned above, in the channel overview screen, the user can easily understand what type of bus is used for each MIX bus.

The CPU 18 determines whether the owner channel is specified or not when the bus of a MIX MINUS type has been set up (S13). When determining that the owner channel is not specified while the bus of a MIX MINUS type has been set up (No at S13), the CPU 18 displays darkly the switch image of the MIX MINUS bus in each channel (S14). Thus, CPU 18 urges a user not to operate the switch image. Note that, a display of the switch image may be made inconspicuous in the display by using other modes such as gray out.

After that, the CPU 18 determines whether a SHIFT key is operated or not, for example, as a specific operation (S15). When determining that the SHIFT key is not operated (No at S15), the CPU 18 further determines whether or not the switch image has been touched to make selection (S16). Until the switch image is touched, the CPU 18 repeats the above determinations from S15. When the switch image is touched, the CPU 18 performs an alarm indication (S17). As shown in FIG. 6A, the CPU 18 displays a message of "Press and hold SHIFT key to specify owner channel," for example. This shows the state where the owner channel is not specified. Therefore, the CPU 18 performs a display for urging a user to specify an owner channel.

Figure 6B:
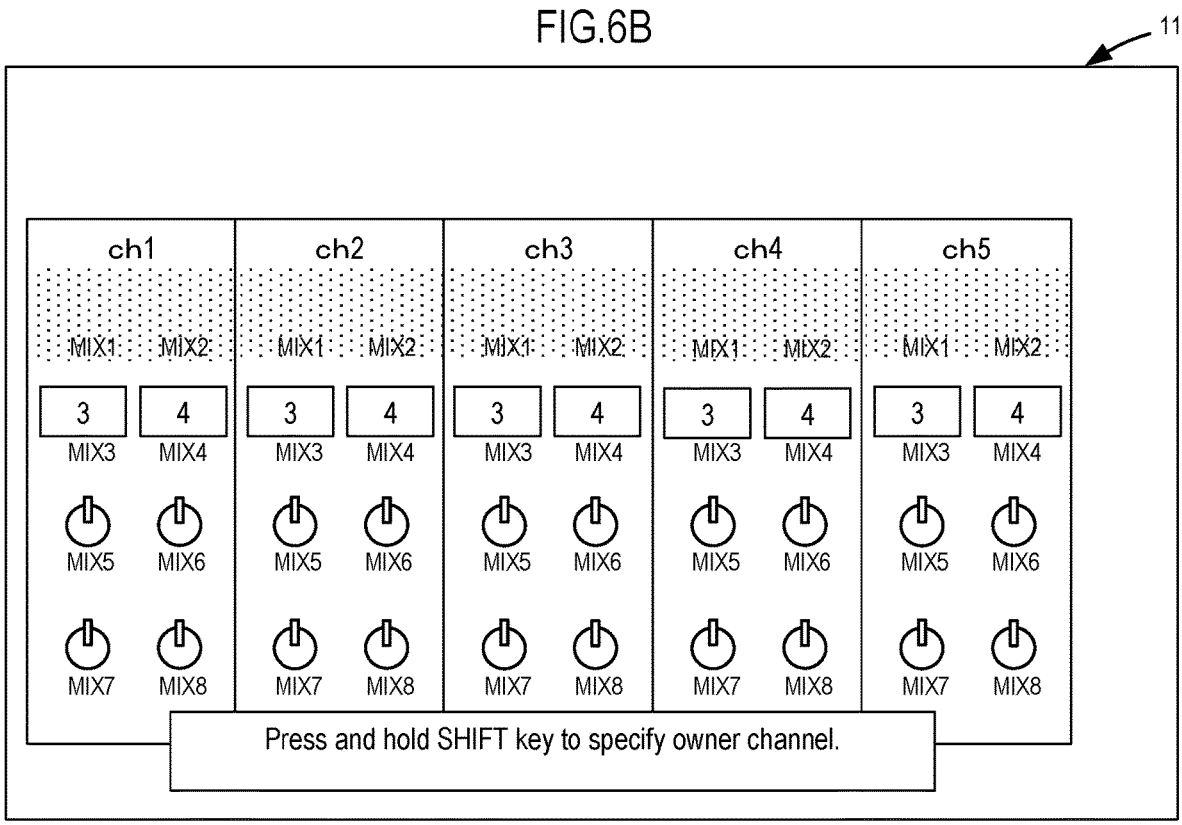
FIG. 6B is a view showing the channel overview screen when the bus of a MIX MINUS type is set up.

As mentioned above, the MIX MINUS bus is a bus that mixes channels other than the specified owner channel to output. When the owner channel is not specified, the MIX MINUS bus is in the state where it is not determined which channel is to be outputted. Therefore, even if the MIX MINUS bus has been set up, when the owner channel is not specified, CPU 18 is set not to output a signal from the MIX MINUS bus. In this case, even if the switch image of the MIX MINUS bus is touched in each channel, the CPU 18 does not output a signal. Accordingly, as shown in FIG. 6B, the CPU 18 may cause the display 11 not to display the switch image of the MIX MINUS bus in each channel. Alternatively, the CPU 18 may, for example, gray out the switch image of the MIX MINUS bus in each channel, so that a display of the switch image is made inconspicuous.

Figure 8A:
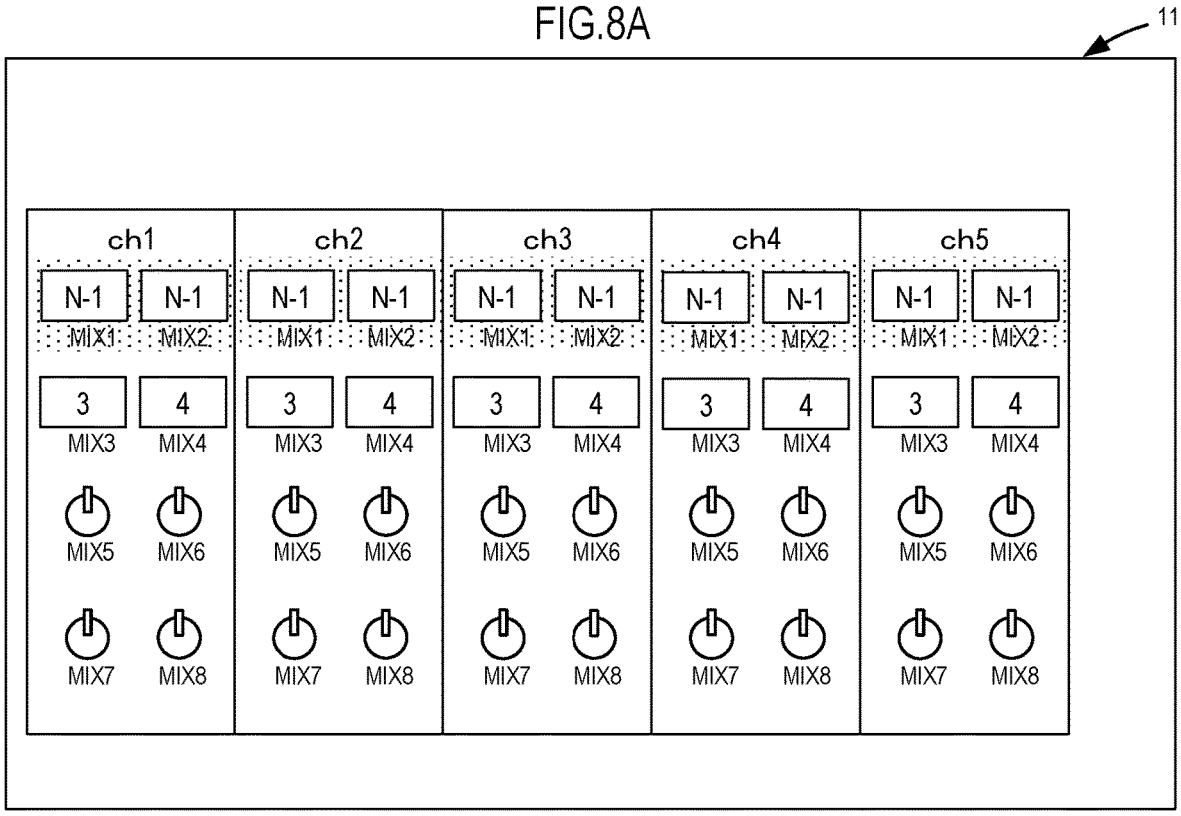
FIG. 8A is a view showing an example of an owner selection screen.

When determining that the SHIFT key has been operated (Yes at S15), the CPU 18 displays an owner selection screen (S18). FIG. 8A is a view showing an example of the owner selection screen. In the owner selection screen, the bus that has been set up as the MIX MINUS bus is indicated by, for example, "N−1" rather than a channel number, and displayed by the CPU 18. Herein, "N−1" shows the state where owner selection is received as a minus target.

Figure 8B:
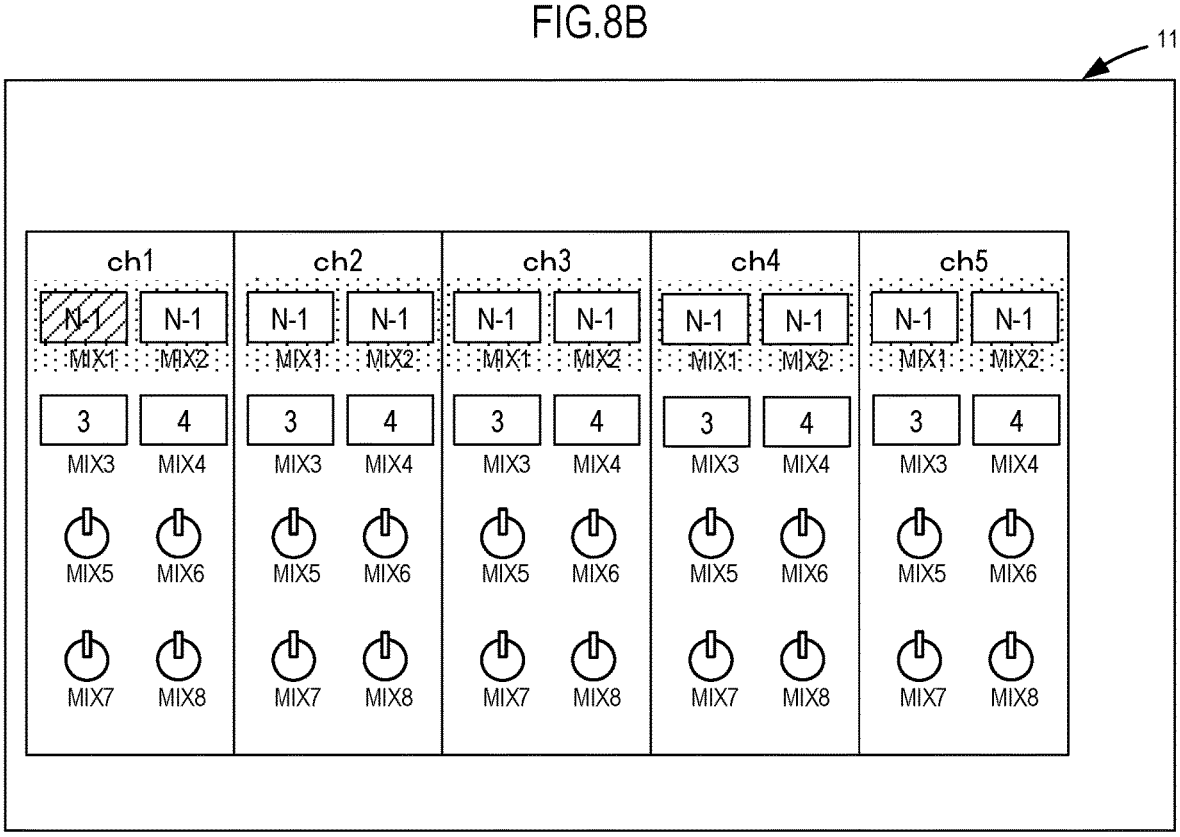
FIG. 8B is a view showing an example of the owner selection screen.

Now, the CPU 18 determines whether or not the owner selection is received from a user (S19). When the user specifies an owner channel (Yes at S19), the CPU 18 associates the specified channel with the MIX MINUS bus (S20). Further, the CPU 18 changes a display of the channel that has been specified as the owner channel (S20). For instance, as shown in FIG. 8B, when the channel 1 is specified as an owner channel of MIX1 serving as the MIX MINUS bus, the CPU 18 changes color of the switch image of MIX1 among buses in the channel 1. Note that, information indicating the correspondence between the owner channel and the MIX MINUS bus is stored in the flash memory 19 or the RAM 20. Note that, like the above-mentioned program, it is not necessary to store the information indicating the correspondence between the owner channel and the MIX MINUS bus in the flash memory 19 or the RAM 20. For instance, the CPU 18 may transmit the information to a server via a network, and cause the server to store it.

Note that, in the determination of S13, when determining that the bus of a MIX MINUS type is set up and the owner channel is specified (Yes at S13), the CPU 18 displays a MIX MINUS button (S21). Then, the CPU 18 determines whether the SHIFT key is pressed or not (S22). When the SHIFT key is not pressed (No at S22), the CPU 18 changes the display of the channel that has been specified as the owner channel (S20). When determining that the SHIFT key is pressed (Yes at S22), the CPU 18 displays the owner selection screen (S18).

After the processing of S20, the CPU 18 determines whether the end of setting is received or not (S23). For instance, when press-and-hold of the SHIFT key is relieved, the CPU 18 receives the end of setting. When determining that the SHIFT key remains pressed (No at S23), the CPU 18 repeats processing from the determination of S19. When press-and-hold of the SHIFT key is relieved (Yes at S23), the CPU 18 returns to the channel overview screen (S24). In configuration of the present embodiment, by pressing the SHIFT key on the channel overview screen, the owner channel of the MIX MINUS bus can be specified on the same channel overview screen. In other words, with the configuration of the present embodiment, the MIX MINUS bus can be set up on the channel overview screen that displays a relationship between a channel and a bus in an easy-to-understand manner.

Figure 9A:
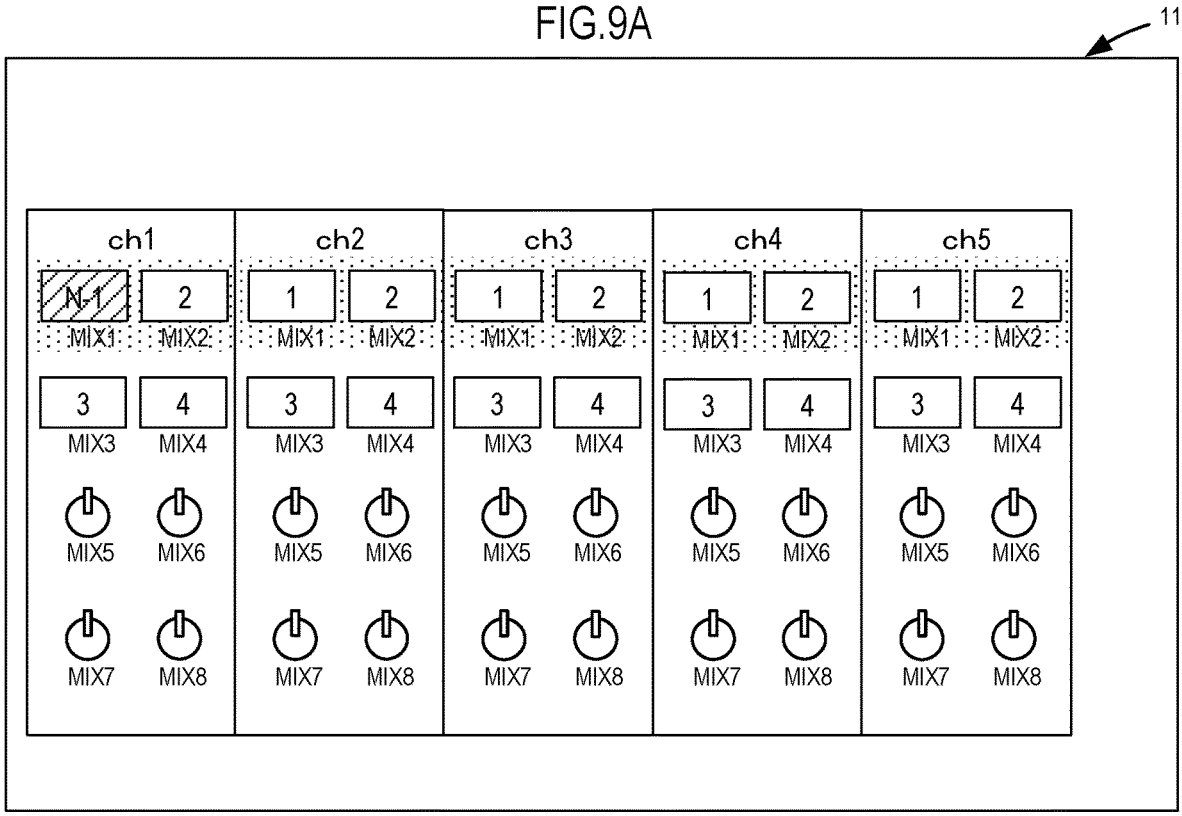
FIG. 9A is a view showing the channel overview screen after an owner channel is specified.
Figure 9B:
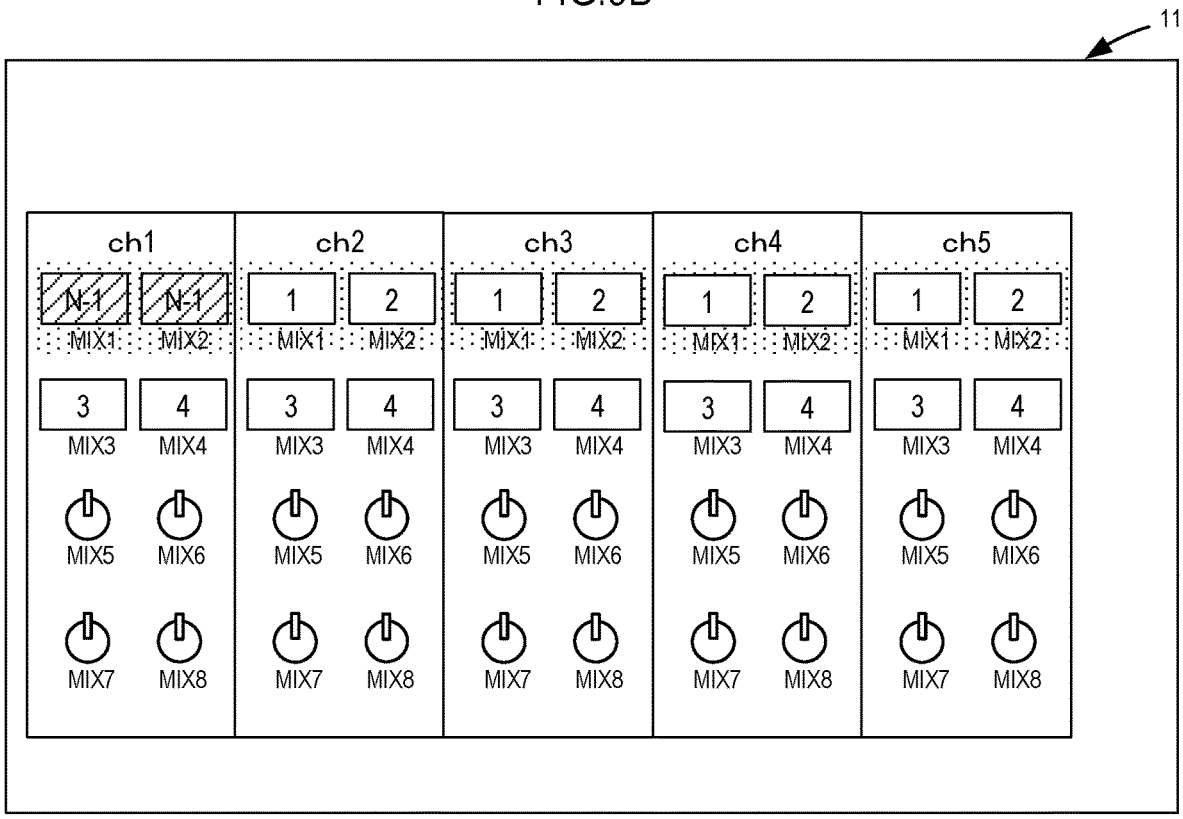
FIG. 9B is a view showing the channel overview screen after the owner channel is specified.

In this way, as shown in FIG. 9A, when the channel 1 is specified as the owner channel, the switch image of MIX1 in the channel 1 is displayed on the channel overview screen with color of the switch image changed. Note that, as shown in FIG. 9B, in the case where the MIX MINUS bus is specified as a stereo bus, if either one of MIX1 or MIX2 is specified, the other one of MIX1 and MIX2 will also be associated with the owner channel.

Figure 10:
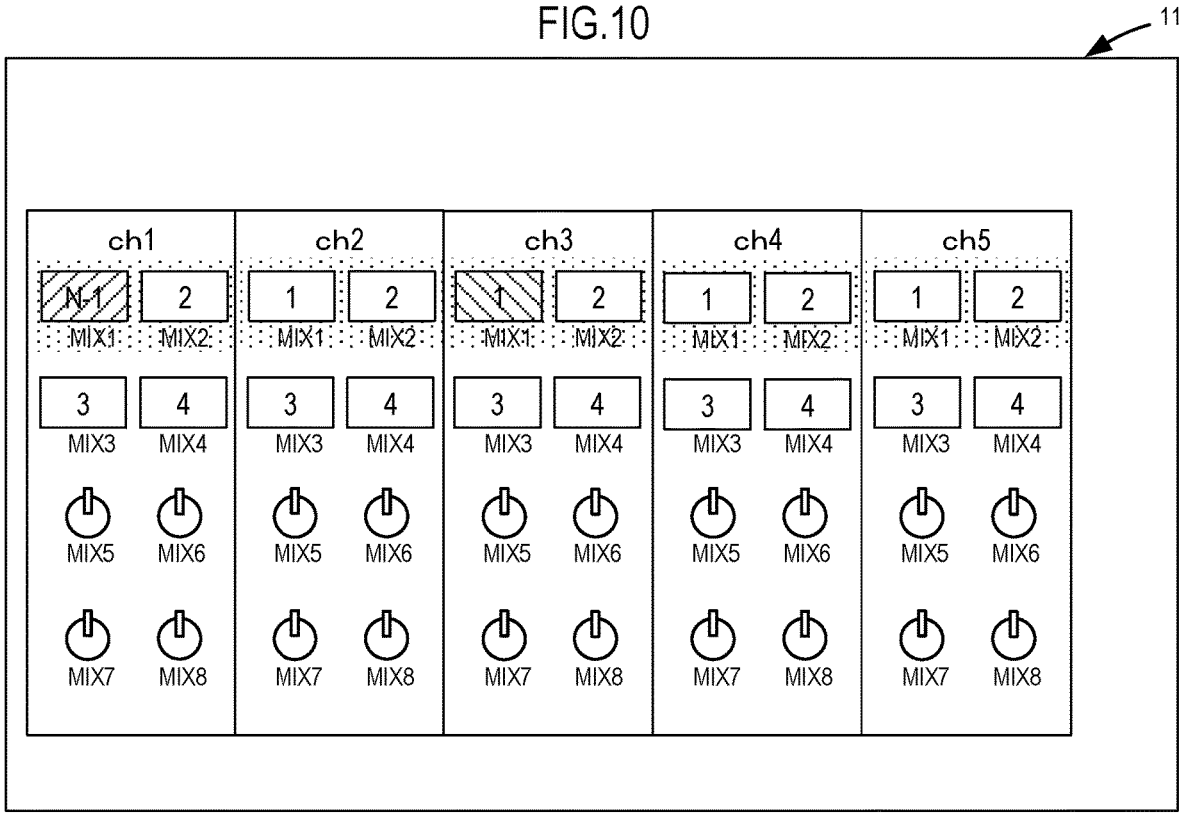
FIG. 10 is a view showing an example of the channel overview screen.

Note that, on the channel overview screen, if a user specifies the MIX MINUS bus in each channel without pressing the SHIFT key, the specified channel is excluded from the MIX MINUS bus, thereby causing the state where a signal of the channel is not outputted. For instance, as shown in FIG. 10, when a user touches the switch image of the MIX1 bus in the channel 3 to exclude the channel 3, the CPU 18 makes the state where a signal of the channel 3 is not outputted to the MIX1 bus. In this case, however, if a user touches the switch image of the MIX1 bus in the channel 3 again, the CPU 18 will return to the state where a signal of the channel 3 is outputted to the MIX1 bus, unlike the owner channel. Further, even in the state where a signal is outputted to the MIX1 bus, the CPU 18 may receive, from a user, an instruction of setting the state where a signal is not outputted outside from the MIX1 bus (mute state). In this case, the signal of the channel is not outputted.

Note that, when determining that the owner channel is not specified while the bus of a MIX MINUS type has been set up (No at S13), the CPU 18 may perform an alarm indication immediately.

Figure 11:
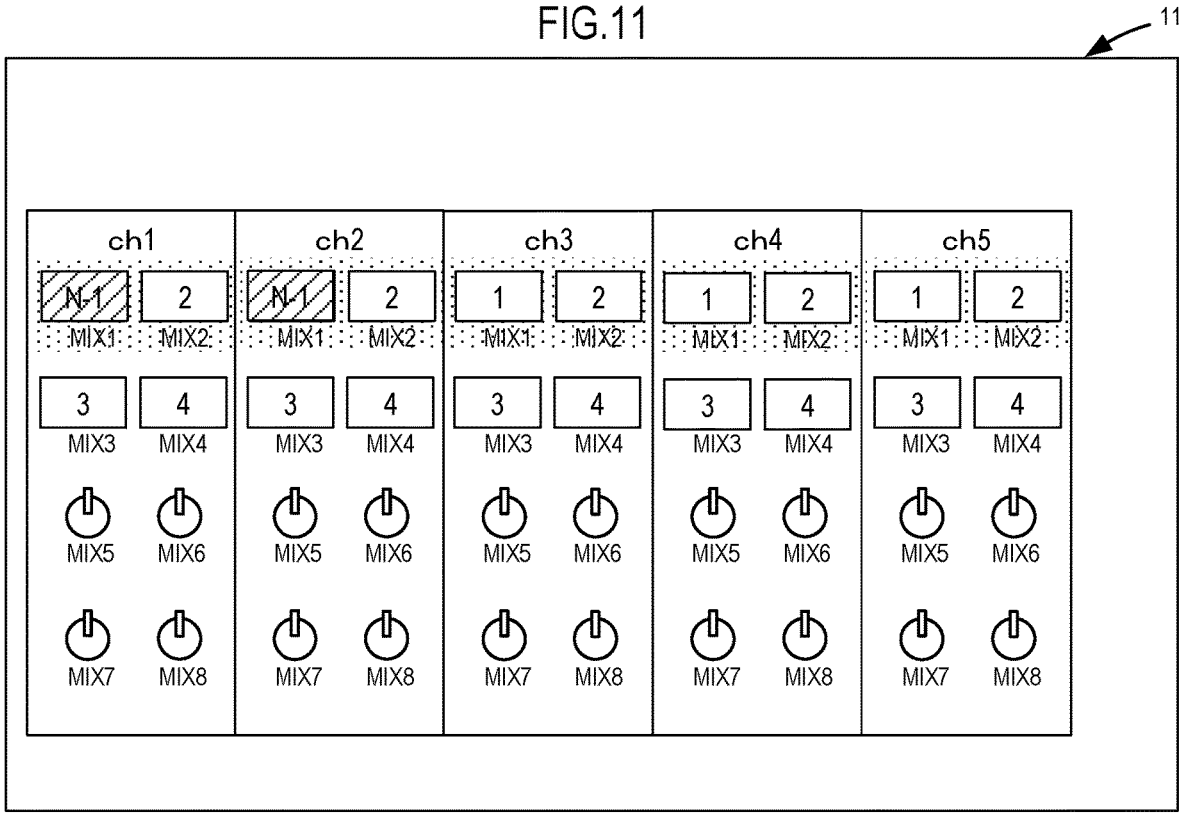
FIG. 11 is a view showing the channel overview screen when two or more channels are specified as the owner channel.

Note that, the owner channel of the MIX MINUS is not limited to one channel. For instance, as shown in FIG. 11, if the channel 2 is further specified as the owner channel of MIX1, the channel 1 and the channel 2 will be associated with MIX1, and color of the switch image of MIX1 in the channel 1 and color of the switch image of MIX1 in the channel 2 will be changed by the CPU 18. In this situation, a signal of channels other than the channel 1 and the channel 2 is outputted to MIX1.

Figure 12:
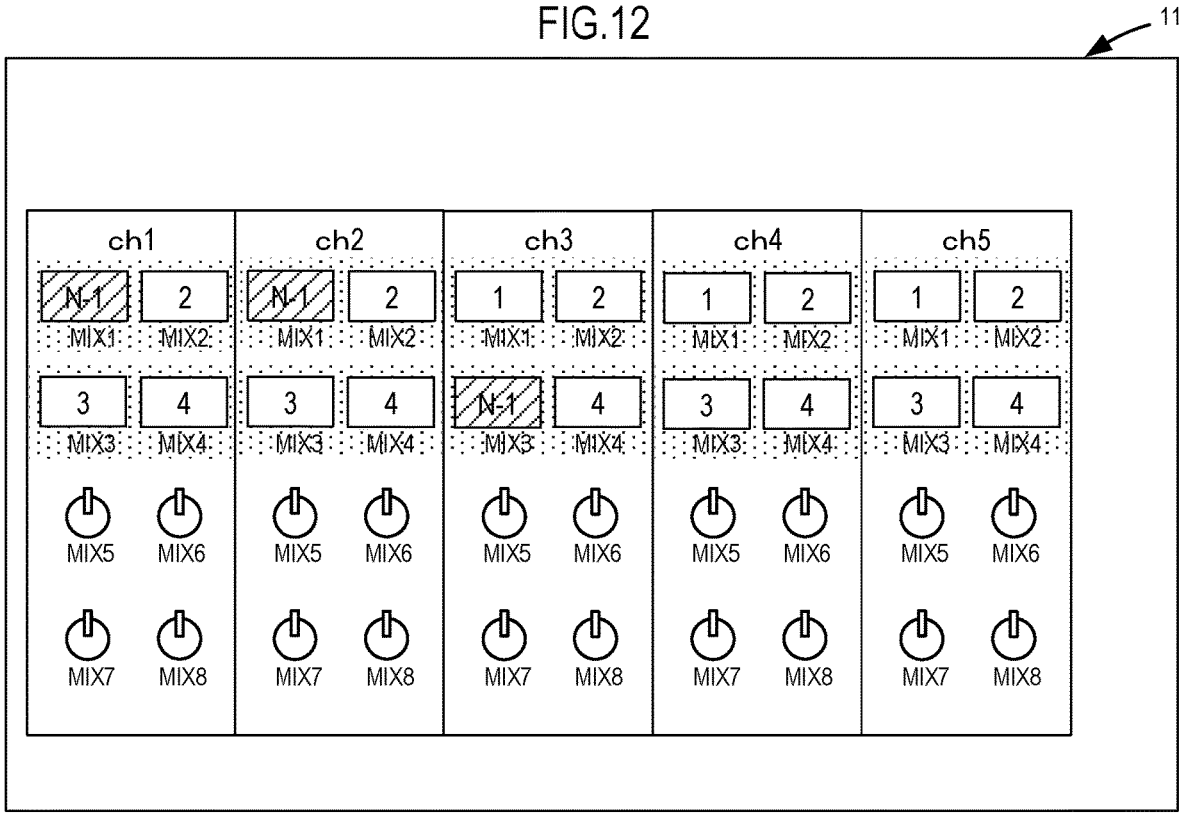
FIG. 12 is a view showing a channel overview screen when a plurality of buses are set up as a MIX MINUS bus.

Further, the number of buses set up as the MIX MINUS bus is not limited to one. For instance, as shown in FIG. 12, the CPU 18 can also set up the MIX3 and MIX4 buses as the MIX MINUS bus. In the example of FIG. 12, since the channel 3 is specified as the owner channel of the MIX3 bus, the CPU 18 associates the channel 3 with the MIX3 bus, and changes the color of the switch image of MIX3 in the channel 3. In this situation, a signal of channels other than channel 3 is outputted to the MIX3 bus.

Figure 13:
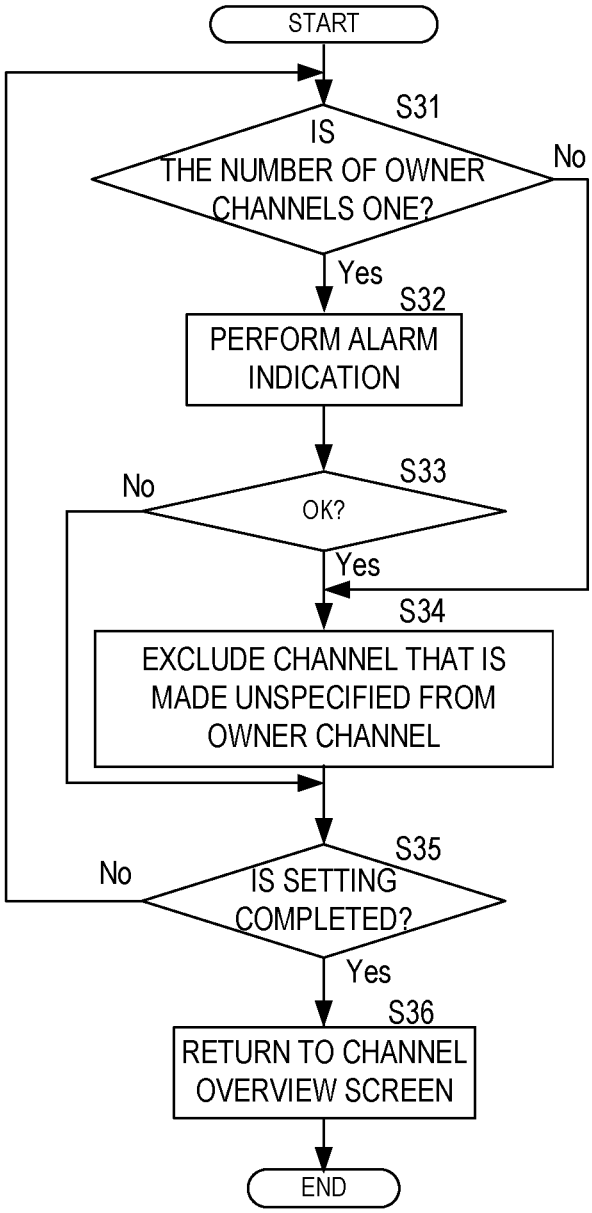
FIG. 13 is a flowchart showing an operation of the CPU 18 when the owner channel is made unspecified.

Next, FIG. 13 is a flowchart showing an operation of the CPU 18 when the owner channel is made unspecified. When a switch image of the MIX MINUS bus in a channel, which has already been specified as the owner channel, is touched on the owner selection screen and the channel is excluded from the owner channel, the CPU 18 performs the operation shown in FIG. 13.

Figure 14:
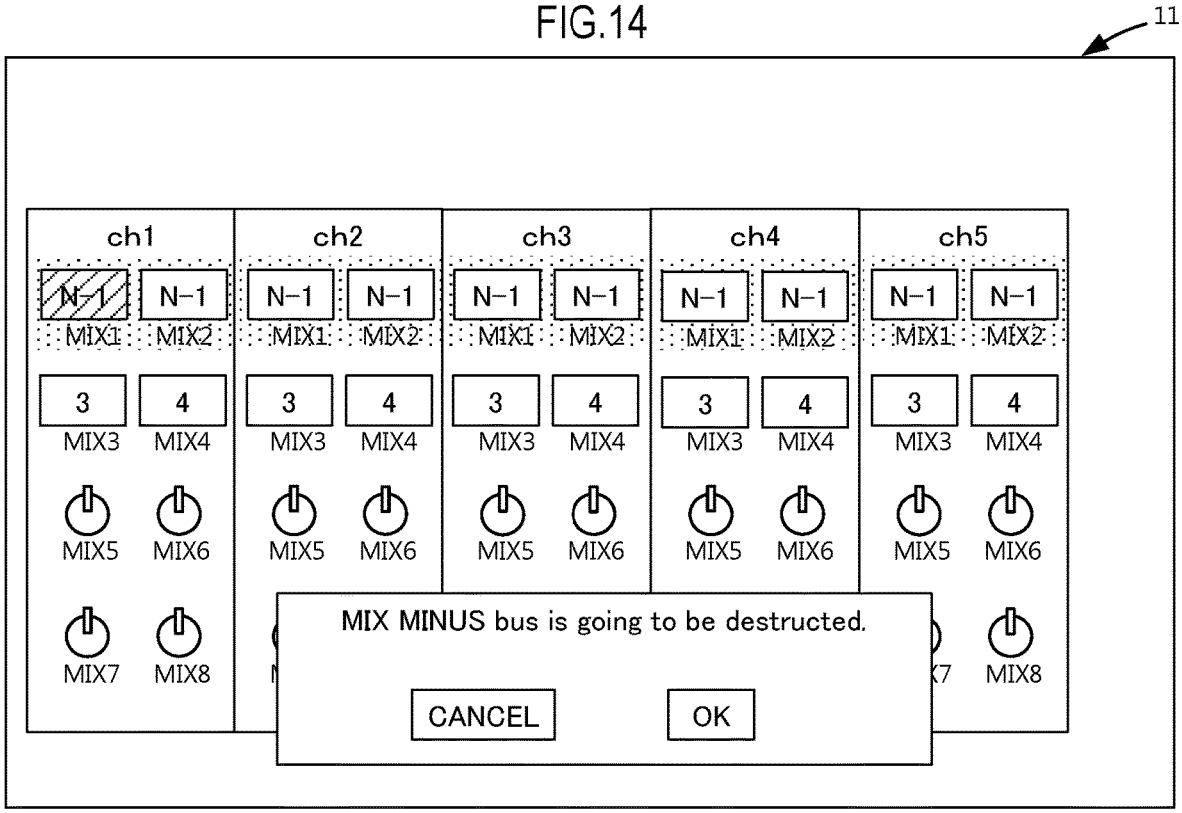
FIG. 14 is an example of an alarm indication when the number of specified owner channels is one.

First, the CPU 18 determines whether the number of current owner channels is one or not (S31). As mentioned above, when the owner channel is not specified, the MIX MINUS bus is in the state where a signal is not outputted. In other words, if the owner channel is made unspecified in the state where the number of current owner channels is one, the MIX MINUS bus will be turned into the state where a signal is not outputted. Accordingly, when the number of specified owner channels is one (Yes at S31), the CPU 18 performs an alarm indication (S32). For instance, as shown in FIG. 14, the CPU 18 displays a message of "MIX MINUS bus is going to be destructed," and requires a user to check the state. Herein, when the user selects an OK-icon image (Yes at S33), the CPU 18 excludes the channel, which is made unspecified, from the owner channel (S34). Further, when two or more owner channels are specified in the determination of S31 (No at S31), the CPU 18 also excludes the channels, which are made unspecified, from the owner channel (S34). Note that, when the user selects a CANCEL image, the CPU 18 maintains the state where the owner channel is specified, without excluding the channel, which is made unspecified, from the owner channel.

Subsequently, after press-and-hold of the SHIFT key is relieved, when determining that the setting is completed (Yes at S35), the CPU 18 returns to the channel overview screen (S36).

As mentioned above, when receiving a specific operation (e.g., press-and-hold of the SHIFT key) and an owner channel is specified, the CPU 18 associates the specified owner channel with a specific bus, and sets the state where a signal of channels other than the owner channel is outputted to the specific bus. This makes it possible for the audio mixer 1 to set up the mix minus function more quickly and simply than before. Note that, the specific operation may be another operation other than press-and-hold of the SHIFT key. For instance, the operation may be press-and-hold of a specific key defined by a user.

Note that, the present embodiment exemplarily shows that various kinds of screens, such as the channel overview screen, are displayed on the display 11 of the audio mixing device, but not limited to this. Various kinds of screens may be displayed on other devices, such as a PC (personal computer).

Lastly, the foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. An audio mixer comprising:

a reception portion that receives a user's operation; and a controller that performs display processing that displays a channel overview screen indicating a correspondence between a plurality of channels and a bus on a display, and setting processing that, in a case where both (i) a specific operation is received through the reception portion and (ii) while the specific operation is being received through the reception portion, a channel included in the plurality of channels and a corresponding bus of the channel are specified as a mix-minus owner channel and a mix-minus bus through the displayed channel overview screen while the channel overview screen is displayed and without having to display another screen, associates the channel specified as the mix-minus owner channel with the mix-minus bus so that a signal of channels other than the associated channel will be output to the mix-minus bus.

2. The audio mixer according to claim 1, wherein the controller changes processing depending on presence or absence of the channel associated with the mix-minus bus.

3. The audio mixer according to claim 1, wherein the controller performs an alarm indication on the display, when the channel is specified.

4. The audio mixer according to claim 1, wherein the controller associates two or more channels with the mix-minus bus.

5. The audio mixer according to claim 1, wherein the reception portion receives an instruction of excluding the channel, and the controller performs an alarm indication on the display, in a case where no channel to be associated with the mix-minus bus when the reception portion receives the instruction of excluding the channel.

6. The audio mixer according to claim 1, wherein the mix-minus bus is related to other buses, and when the channel is specified, the controller associates the specified channel with the other buses that are related to the mix-minus bus associated with the specified channel.

7. The audio mixer according to claim 1, wherein the channel included in the plurality of channels and the corresponding bus of the channel are specified as the mix-minus owner channel and the mix-minus bus by receiving a single user operation through the displayed channel overview screen while the specific operation is received.

8. A control method of an audio mixer comprising:

displaying a channel overview screen that indicates a correspondence between a plurality of channels and a bus; and associating a channel specified as a mix-minus owner channel with a mix-minus bus so that a signal of channels other than the associated channel will be output to the mix-minus bus in a case where both (i) a specific operation is received from a user and (ii) while the specific operation is being received, the channel included in the plurality of channels and a corresponding bus of the channel are specified as the mix-minus owner channel and the mix-minus bus through the displayed channel overview screen while the channel overview screen is displayed and without displaying another screen.

9. The control method of the audio mixer according to claim 8, further comprising changing processing depending on presence or absence of the channel associated with the mix-minus bus.

10. The control method of the audio mixer according to claim 8, further comprising performing an alarm indication when the channel is specified.

11. The control method of the audio mixer according to claim 8, further comprising associating two or more channels with the mix-minus bus.

12. The control method of the audio mixer according to claim 8, further comprising:

receiving an instruction of excluding the channel; and performing an alarm indication, in a case where no channel to be associated with the mix-minus bus when the instruction of excluding the channel is received.

13. The control method of the audio mixer according to claim 8, wherein the mix-minus bus is related to other buses, and the control method comprises, when the channel is specified, associating the specified channel with the other buses that are related to the mix-minus bus associated with the specified channel.

14. The control method of the audio mixer according to claim 8, wherein the channel included in the plurality of channels and the corresponding bus of the channel are specified as the mix-minus owner channel and the mix-minus bus by receiving a single user operation through the displayed channel overview screen while the specific operation is received.

* * * * *